US008997987B1

(12) United States Patent
Block

(10) Patent No.: US 8,997,987 B1
(45) Date of Patent: Apr. 7, 2015

(54) WRAP-AROUND CONTAINER CARRIER

(71) Applicant: The C.W. Zumbiel Company, Hebron, KY (US)

(72) Inventor: Steven J. Block, Amelia, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 0 days.

(21) Appl. No.: 13/871,324

(22) Filed: Apr. 26, 2013

Related U.S. Application Data

(60) Provisional application No. 61/648,303, filed on May 17, 2012.

(51) Int. Cl.
*B65D 71/00* (2006.01)
*B65D 1/22* (2006.01)

(52) U.S. Cl.
CPC ..... *B65D 1/22* (2013.01)

(58) Field of Classification Search
USPC ..... 206/434, 427, 433, 429, 139
See application file for complete search history.

(56) References Cited

U.S. PATENT DOCUMENTS

| | | | | | |
|---|---|---|---|---|---|
| 4,202,446 | A | * | 5/1980 | Sutherland | 206/147 |
| 4,784,266 | A | * | 11/1988 | Chaussadas | 206/434 |
| 4,796,754 | A | | 1/1989 | Chaussadas et al. | |
| 4,919,266 | A | | 4/1990 | McIntosh, Jr. et al. | |
| 5,156,269 | A | | 10/1992 | Bakx | |
| 5,246,112 | A | * | 9/1993 | Stout et al. | 206/427 |
| 5,427,241 | A | * | 6/1995 | Sutherland | 206/427 |
| 5,472,090 | A | | 12/1995 | Sutherland | |
| 5,597,071 | A | | 1/1997 | Sutherland | |
| 5,682,995 | A | | 11/1997 | Sutherland | |
| 5,692,614 | A | | 12/1997 | Harris | |
| 5,704,470 | A | * | 1/1998 | Sutherland | 206/147 |
| 5,944,253 | A | | 8/1999 | Miller et al. | |
| 5,947,367 | A | | 9/1999 | Miller et al. | |
| 6,019,220 | A | | 2/2000 | Sutherland | |
| 6,021,897 | A | | 2/2000 | Sutherland | |
| 6,021,899 | A | | 2/2000 | Sutherland | |
| 6,109,438 | A | * | 8/2000 | Sutherland | 206/427 |
| 6,227,367 | B1 | * | 5/2001 | Harrelson et al. | 206/427 |
| 6,241,083 | B1 | * | 6/2001 | Harrelson | 206/141 |
| 7,762,394 | B2 | * | 7/2010 | Bradford et al. | 206/427 |
| 7,762,397 | B2 | | 7/2010 | Coltri-Johnson et al. | |
| 7,766,219 | B2 | * | 8/2010 | Gomes et al. | 229/122 |
| 7,870,994 | B2 | * | 1/2011 | Spivey et al. | 229/122 |
| 2013/0075392 | A1 | * | 3/2013 | Learn et al. | 220/6 |

* cited by examiner

*Primary Examiner* — Steven A. Reynolds
(74) *Attorney, Agent, or Firm* — Wood, Herron & Evans, LLP

(57) ABSTRACT

A carrier is constructed from paperboard and includes a rounded or non-rectangular top in combination with a non-rounded or rectangular bottom. Dust flaps which extend from the top and bottom of the carrier overlap one another to form a pair of opposing composite side panels. The dust flaps which are attached to the side panels include a crease or fold line adjacent to the bottom of the carrier which only extends partially along the height of the carrier so that the juncture between the side flap and the associated side panel adjacent the top of the carrier does not include a crease or fold line. As such, the side panel and adjacent side flap adjacent the top of the carrier can be tightly wrapped around the arcuate sidewall of the containers within the carrier to thereby provide a neat and tightly packed package configuration.

25 Claims, 9 Drawing Sheets

WRAP-AROUND CONTAINER CARRIER

This claims priority to U.S. Provisional Application Ser. No. 61/648,303, filed May 17, 2012, and hereby incorporated by reference in its entirety.

BACKGROUND OF THE INVENTION

The invention relates, generally, to article carriers. More particularly, the invention relates to wrap-around article carriers formed by wrapping a flat carrier blank around a configuration of containers.

Wrap-around article carriers are commonly used to package beverage containers and other articles. Basically, one type of wrap-around article carrier is formed by grouping articles in an arrangement they are desired to be in after packaging to form a product configuration, and then wrapping a flat carrier blank around the product configuration. The blank is tightly drawn about the articles and the ends of the blank are connected to each other. Cutouts are often provided at the upper and/or lower portions of the ends of the carrier to grip the exposed portions of the articles protruding through the cutouts. The cutouts allow the blank to be tightly wrapped around and to securely hold the product group. Wrap-around article carriers are economical to make and use because they typically use a smaller amount of paperboard than other carriers, and because they are stored and transported as a flat carrier blank or as a carrier sleeve. Furthermore, wrap-around article carriers are sturdy and are well-accepted by the public.

One aspect of wrap-around carriers which has been well received by the public is the ability to view at least a portion of the containers contained within the carrier. Typically, the containers have a cylindrical shape with an arcuate sidewall and at least a portion of that sidewall is often viewable through the carrier wrapped around the configuration of containers. Examples of this feature of prior art wrap-around containers are shown in U.S. Pat. Nos. 4,919,266; 5,944,253 and 5,947,367, each of which is incorporated herein by reference in its entirety.

Moreover, another feature of such wrap-around carriers which has been well received by the public is the ability to provide a sturdy and tightly packed grouping of containers. The ability for the carrier material or paperboard to conform to the arcuate profile of the containers adds to this advantageous feature while additionally minimizing the quantity of paperboard required for each carrier package.

Nevertheless, many carrier manufacturers and paperboard converters who fill the erected carrier with the containers prior to shipment to the commercial retailer and ultimate consumer have identified certain difficulties in properly loading the containers within the carrier. Various machines require added equipment and certain modifications to properly process the containers in an assembled configuration into the paperboard carrier. One aspect of known paperboard carriers which leads to these required modifications is the rounded shape or configuration of the base portion of the carrier.

Therefore, what is needed is an improved paperboard carrier which provides the above-identified and other advantages and desirable features while minimizing or avoiding the need for modifications to existing equipment for processing and filling the carriers.

SUMMARY OF THE INVENTION

These and other drawbacks in the prior art have been addressed and overcome with a carrier and associated blank of this invention. A carrier of this invention in various embodiments is constructed from a paperboard blank and includes a rounded or non-rectangular top in combination with a non-rounded or rectangular bottom. Dust flaps which extend from the top and bottom of the carrier overlap one another to form a pair of opposing composite end panels. Sides of the carton also include dust flaps which extend from the respective edges and those side dust flaps are likewise folded onto the composite end panels. One advantageous feature of the carrier according to various embodiments of this invention is that the dust flaps which are attached to the side panels include a crease or fold line adjacent to the bottom of the carrier. The crease or fold line only extends partially along the height of the carrier so that the juncture between the side flap and the associated side panel adjacent to the top of the carrier does not include a crease or fold line. As such, the side and adjacent side flap adjacent the top of the carrier can be tightly wrapped around the arcuate sidewall of the containers within the carrier to thereby provide a neat and tightly grouped package configuration. Moreover, the sturdy and tightly packed container configuration within the carrier allows for viewing ports adjacent the top panel to provide the consumer visual access for viewing the containers within the carriers without sacrificing structural integrity of the sturdy carrier.

Moreover, the rectangular configuration of the bottom resulting in part from the side flap fold lines allows for more efficient and easier processing and filling of the carrier blank in an assembled configuration thereby avoiding the need for added equipment and modifications to the existing converting machinery and processing equipment.

Other advantages and objects of this invention will be apparent from the following description, the accompanying drawings, and the appended claims.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
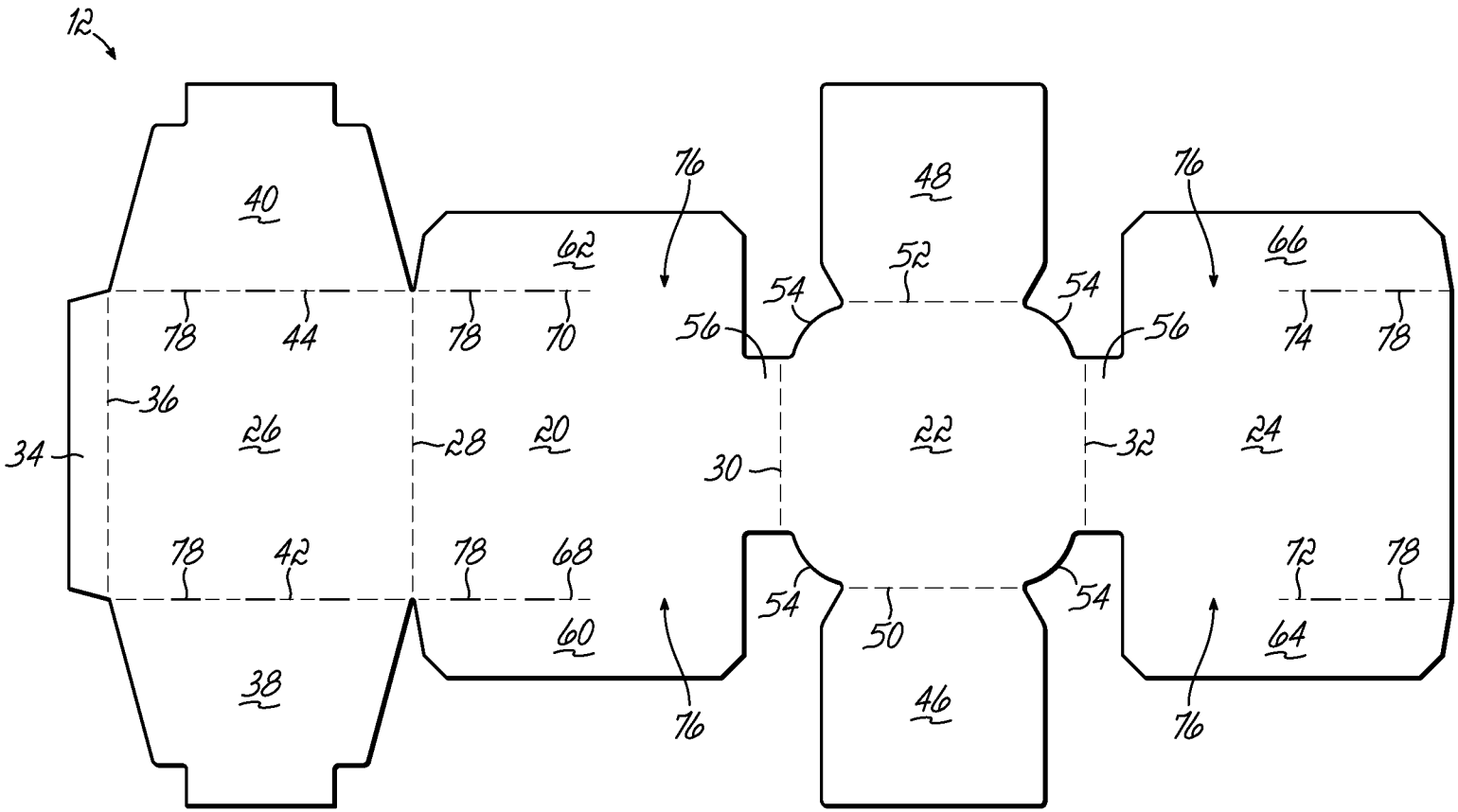
FIG. 1 is a plan view of a blank for forming a carrier for containers according to one embodiment of this invention.
Figure 2:
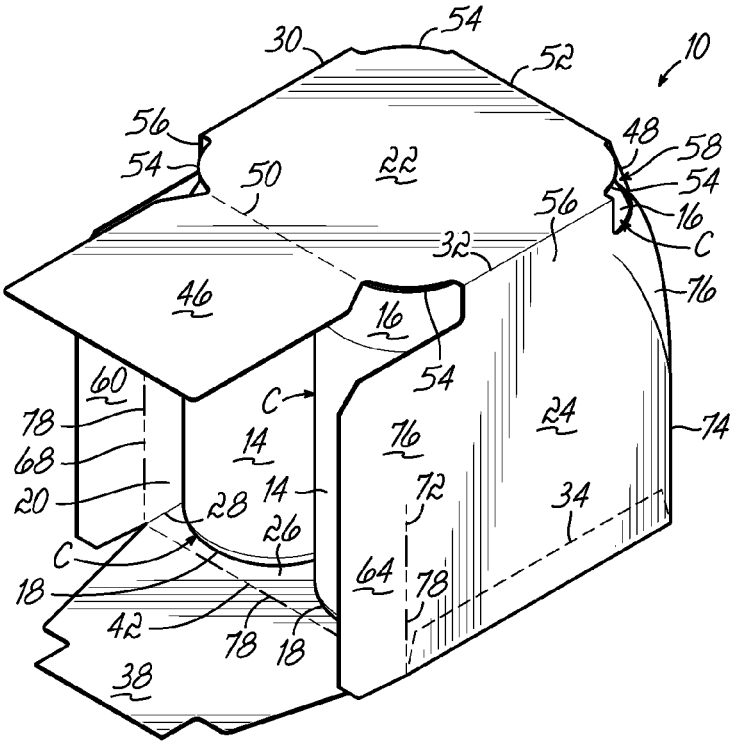
FIGS. 2-3 are sequential perspective views of a carrier holding containers and being constructed from the blank of FIG. 1.
Figure 3:
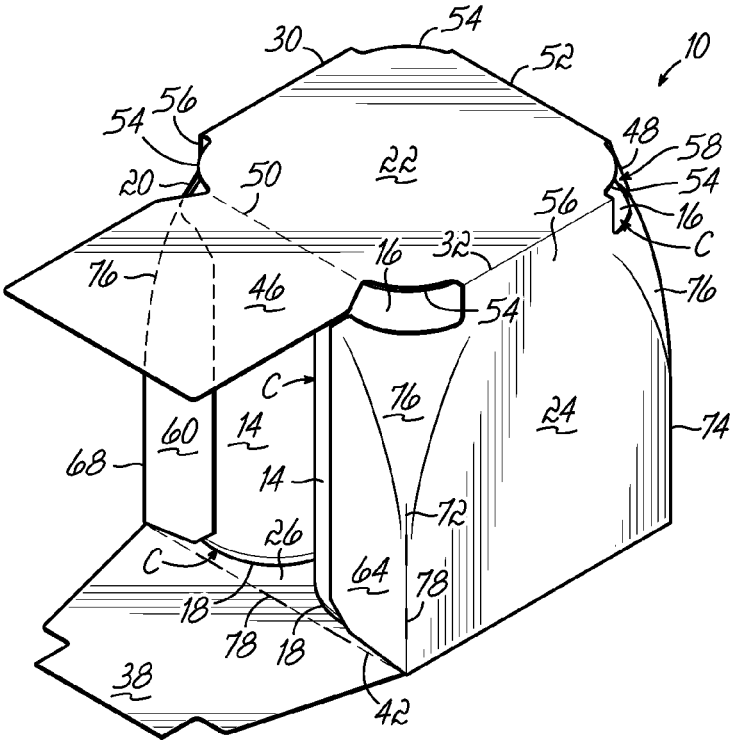

FIGS. 2-7 illustrate a first embodiment of a carrier 10 according to this invention. FIG. 1 illustrates a blank 12 from which the carrier 10 of FIGS. 2-7 is formed. Cans or containers "C" arranged in a 2×2 array are shown in FIGS. 2-7 as an aid in understanding the invention. However, this invention is not limited to a 2×2 arrangement and is readily used in a 2×3, other arrangement and/or sizes and types of containers. The cans "C" are each similarly oriented and have a cylindrical shape with an arcuate sidewall 14 extending from a top crown 16 of each container 14 to a bottom 18.

Referring to FIG. 1, the blank 12 includes four primary panels for forming carrier walls including a first side panel 20, a top panel 22, a second side panel 24 and a bottom panel 26 foldably connected one to the next along fold lines 28, 30 and 32. A glue flap 34 is foldably connected to bottom panel 26 along fold line 36.

Pair of bottom flaps 38, 40 is attached to and extend from opposite ends of the bottom panel 26 as shown in FIG. 1. Each bottom flap 38, 40 is connected to the bottom panel 26 by a respective fold line 42, 44. Similarly, a pair of opposed top flaps 46, 48 adjoin to the top panel 22 each by an associated fold line 50, 52. The fold lines 42, 44, 34, 28 joining the bottom flaps 38, 40, glue flap 36 and side panel 20 to the bottom panel 26 are each oriented approximately 90 degrees relative to the adjacent fold line and form a rectangular-shaped bottom panel 26 which in one embodiment is square in that the lengths of the fold lines 28, 36, 42, 44 bordering the bottom panel 26 are all equal. An arcuate corner 54 is at the juncture between each pair of adjacent fold lines bordering the top panel 22. Additionally, an extended neck portion 56 of the respective side panel 20, 24 at the juncture between each side panel 20, 24 and the top panel 22. The arcuate corners 54 of the top panel 22 and the neck portions 56 of the side panels 20, 24 combine to form viewing ports 58 of the carrier 10 when erected around the container configuration as shown in FIGS. 2-7.

Pairs of opposed side flaps 60, 62 and 64, 66 are each joined to and extend from the opposite edges of the side panels 20, 24 as shown in the blank 12 in FIG. 1. Each side flap 60, 62, 64, 66 is joined to the associated side panel 20, 24 by a side flap fold line 68, 70, 72, 74. Each side flap fold line 68, 70, 72, 74 according to one aspect of this invention extends only partially along the juncture between the side flap 60, 62, 64, 66 and the associated side panel 20, 24 as shown in FIG. 1. Specifically, each side flap fold line 68, 70, 72, 74 extends from the portion of the side panel 20, 24 adjacent to the bottom panel 26 toward the top panel 22; however, according to one aspect of this invention, the side flap fold lines 68, 70, 72, 74 do not extend the entire height of the associated side flap 60, 62, 64, 66, side panels 20, 24 or the erected carrier 10 as shown in FIGS. 2-7. In one embodiment, each side flap fold line 68, 70, 72, 74 extends approximately 50 percent of the height of the carrier 10 or about half way from the bottom panel 26 to the top panel 22 in the erected carrier 10. As such, a portion of each side flap 60, 62, 64, 66 is joined to the associated side panel 20, 24 by the side flap fold line 68, 70, 72, 74 to form a non-arcuate juncture therebetween and the remainder of each side flap 60, 62, 64, 66 is joined to the associated side panel 20, 24 without the benefit of a fold line as shown by region 76 to form an arcuate juncture between the adjacent associated panels.

In one embodiment, the fold lines 30, 32, 50, 52, 36, 28 bordering the top panel 22 and joining the glue flap 34 and side panel 20 to the bottom panel 26 are creased, indented or embossed to promote the folding of the adjacent components about these fold lines. Another aspect of one embodiment of this invention is that the fold lines 42, 44, 68, 70, 72, 74 joining the bottom panel 26 to the bottom flaps 38, 40 and those joining the side flaps 60, 62, 64, 66 to the associated side panels 20, 24 are each cut crease fold lines which include a series of spaced cuts or slits 78 along the fold line as well as associated creased, embossed or indented portions intermediately spaced between the cuts 78 in the paperboard. One of ordinary skill in the art would readily appreciate that alternative types of fold lines, crease lines, features or enhancements to the paperboard may be provided to allow the carrier blank 12 to be folded and erected into the carrier 10 according to various embodiments of this invention aside from those described and shown herein.

Figure 4:
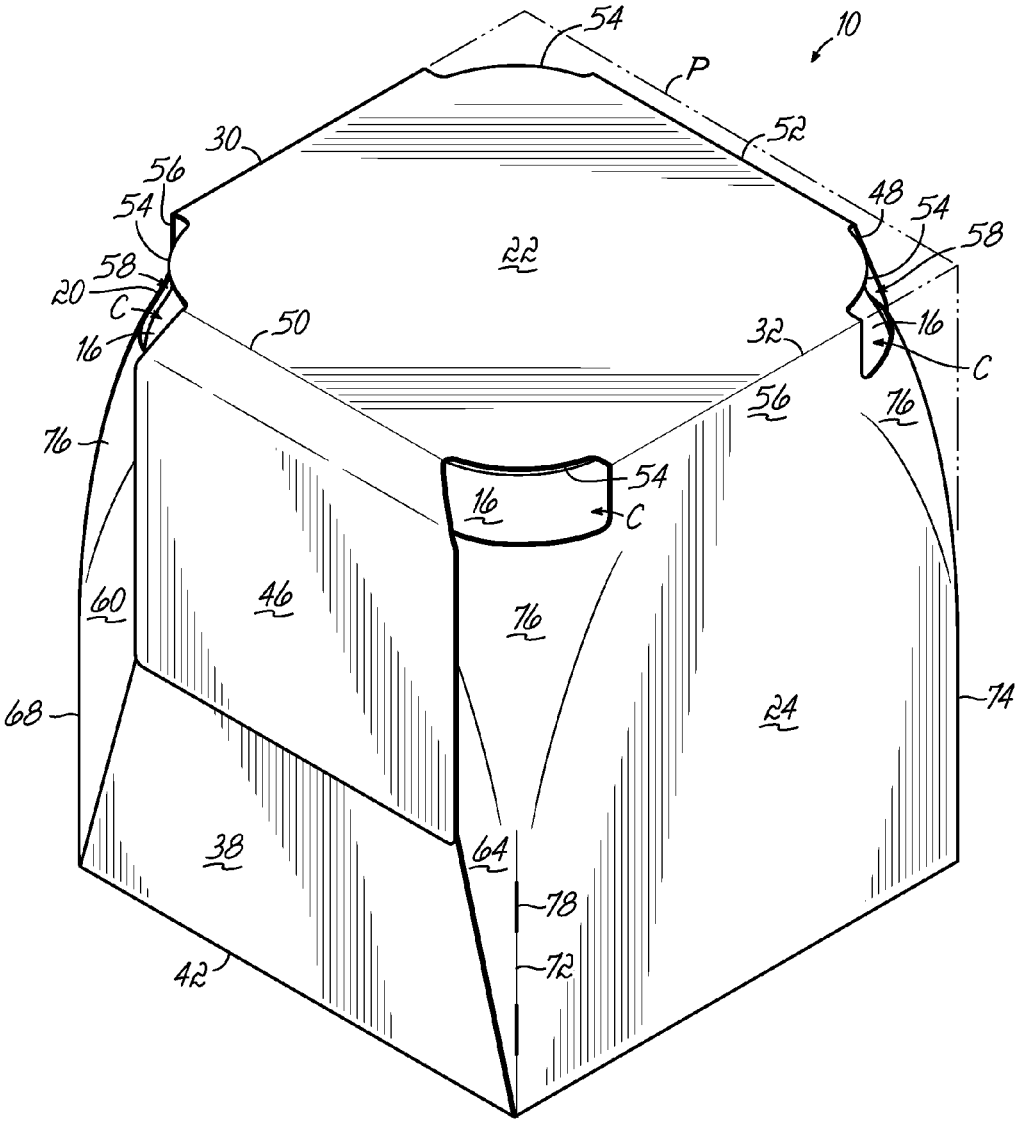
FIG. 4 is a perspective view of the formed carrier of FIGS. 2-3.
Figure 5:
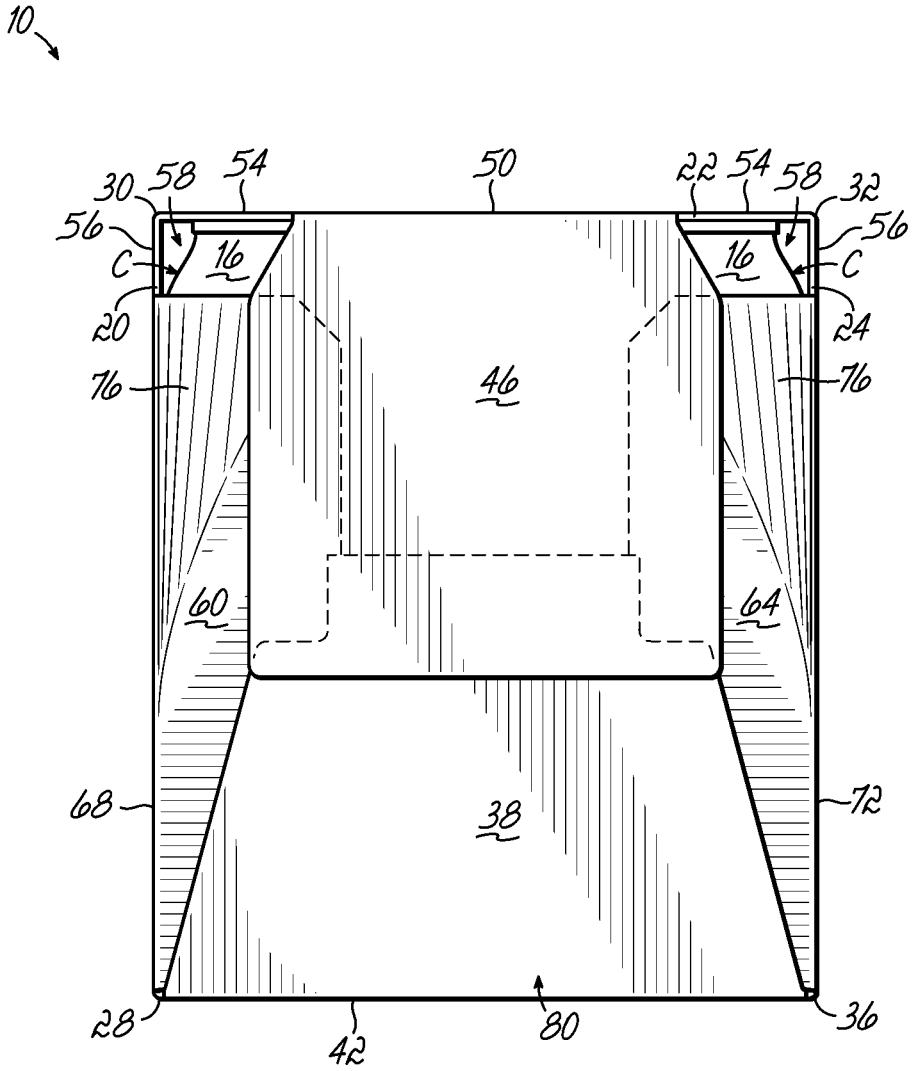
FIG. 5 is an elevational view of one end of the carrier of FIGS. 2-4.
Figure 6:
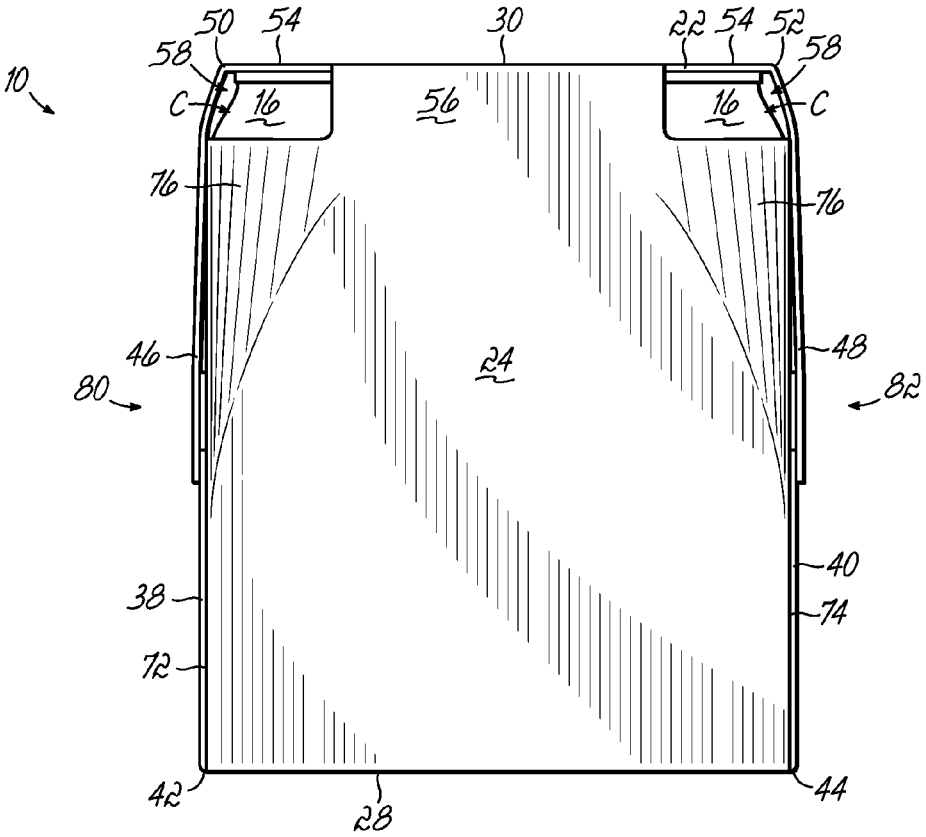
FIG. 6 is an elevational view of one side of the carrier of FIGS. 2-5.
Figure 7:
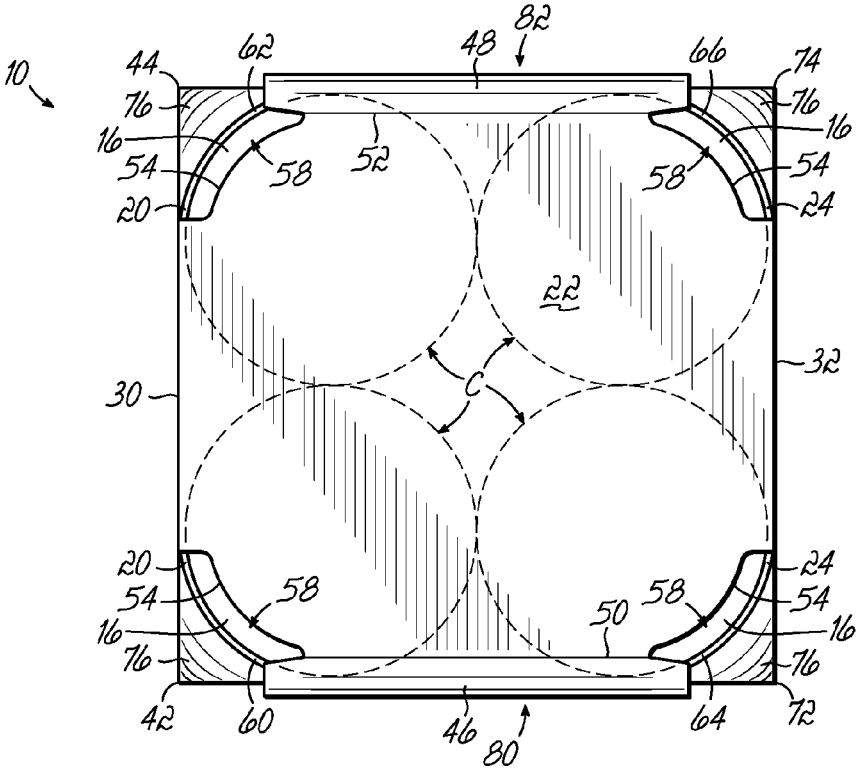
FIG. 7 is a top view of the carrier of FIGS. 2-6.

To form an erected carrier 10 from the blank 12, the configuration of containers C is loaded onto the bottom panel 26 of the carrier blank 12 and is shown in a 2×2 arrangement in FIGS. 2-7, although other configurations of containers C are possible within the scope of this invention. Each container C is oriented with its longitudinal axis generally perpendicular to the bottom panel 26 and is similarly oriented relative to one another such that each container bottom 18 is resting on the bottom panel 26. The side panel 24 is then folded around about fold line 32 and the containers C so that a distal portion of the side panel 24 overlaps the glue flap 34 which is then adhesively secured to the side panel 24. The side flaps 60, 62, 64, 66 are then folded about respective fold lines 68, 70, 72, 74 relative to the associated side panels 20, 24 (FIG. 3) after which the bottom flaps 38, 40 are folded upwardly about their associated fold lines 42, 44 and the top flaps 46, 48 are folded downwardly about fold lines 50, 52 to overlap the adjacent portion of the bottom flaps 38, 40 and side flaps 60, 62, 64, 66 (FIG. 4). The respective flaps 38, 40, 46, 48, 60, 62, 64, 66 are adhesively secured to one another via deposits of glue or another means as is well known in the industry. The overlapping flaps 38, 60, 46 and 64 form one composite end panel 80 (FIGS. 4-5) of the carrier 10 and overlapping flaps 40, 62, 48, 66 and form another composite end panel 82 (FIGS. 6-7).

One aspect of the carrier 10 according to this invention is the generally perpendicular orientation of the side panels 20, 24 relative to the composite end panels 80, 82 adjacent the bottom panel 26 due in part to the side flap fold lines 68, 70, 72, 74. However, the upper portion of each side panel 20, 24 and the adjacent portions of the respective end panels 80, 82 designated by areas 76 are formed or wrapped tightly around the upper portion of the arcuate sidewalls 14 of the containers C adjacent the viewing ports 58 of the carrier 10 as shown in FIGS. 2-7. This arrangement of the carrier 10 and the associated fold lines and side flaps allows for the generally rectangular configuration of the bottom panel 26 and the rounded or non-rectangular configuration of the upper portion of the carrier 10 to provide a snug wrapping by areas 76 of the cylindrical containers C. Phantom lines P in FIG. 4 show the profile of a carrier with a traditional upper rectangular profile. Exposure of the containers C in the carrier 10 is provided by the viewing ports 58 bound in part by the arcuate corners 54 and the neck portions 56.

A side view of the erected carrier 10 according to certain aspects of this invention presents a rectangular profile as shown in FIG. 5, whereas the upper portions of the containers C are wrapped in areas 76 by the carrier 10.

Figure 8:
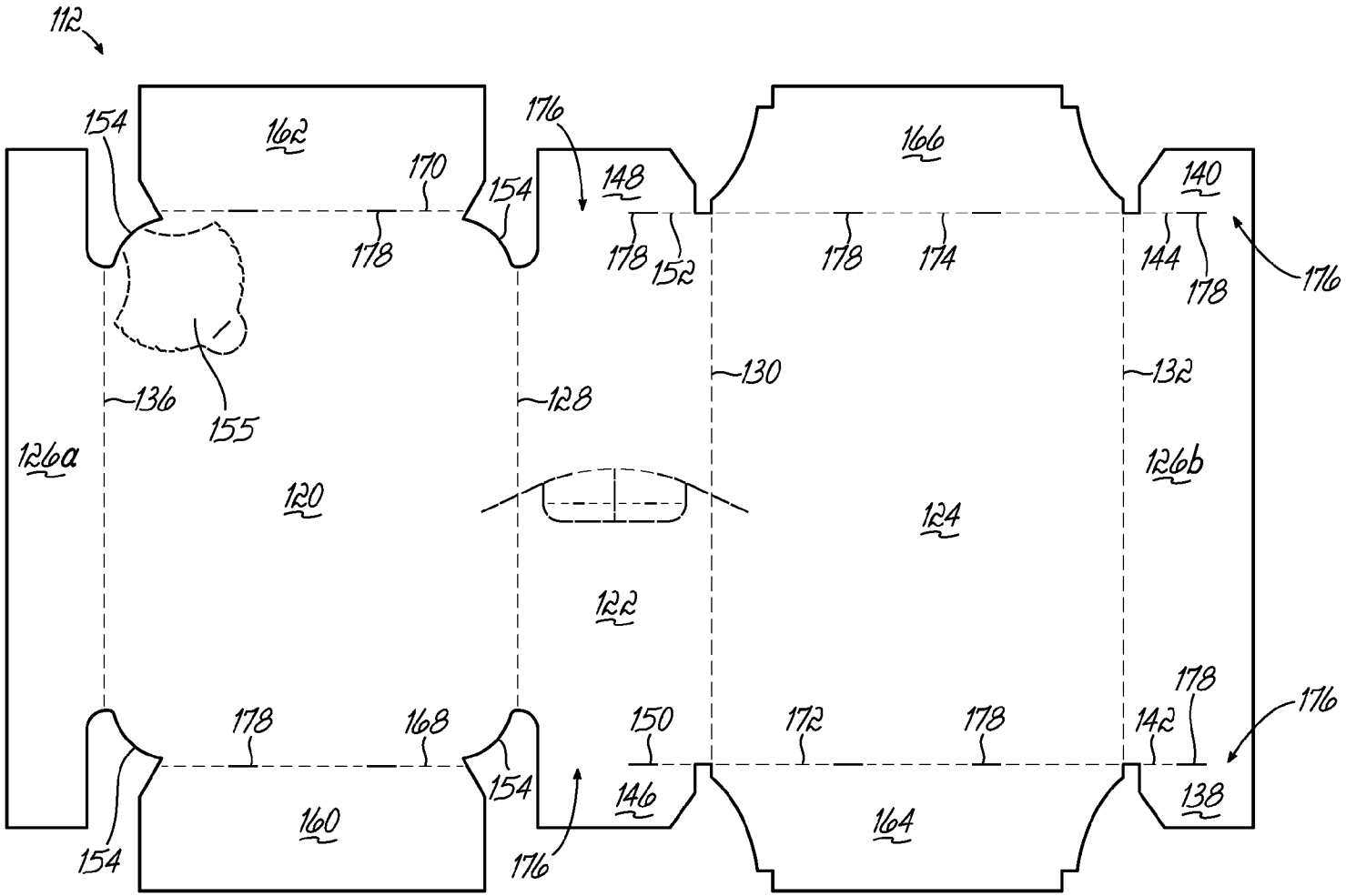
FIG. 8 is a plan view of a blank according to another embodiment of this invention.
Figure 9:
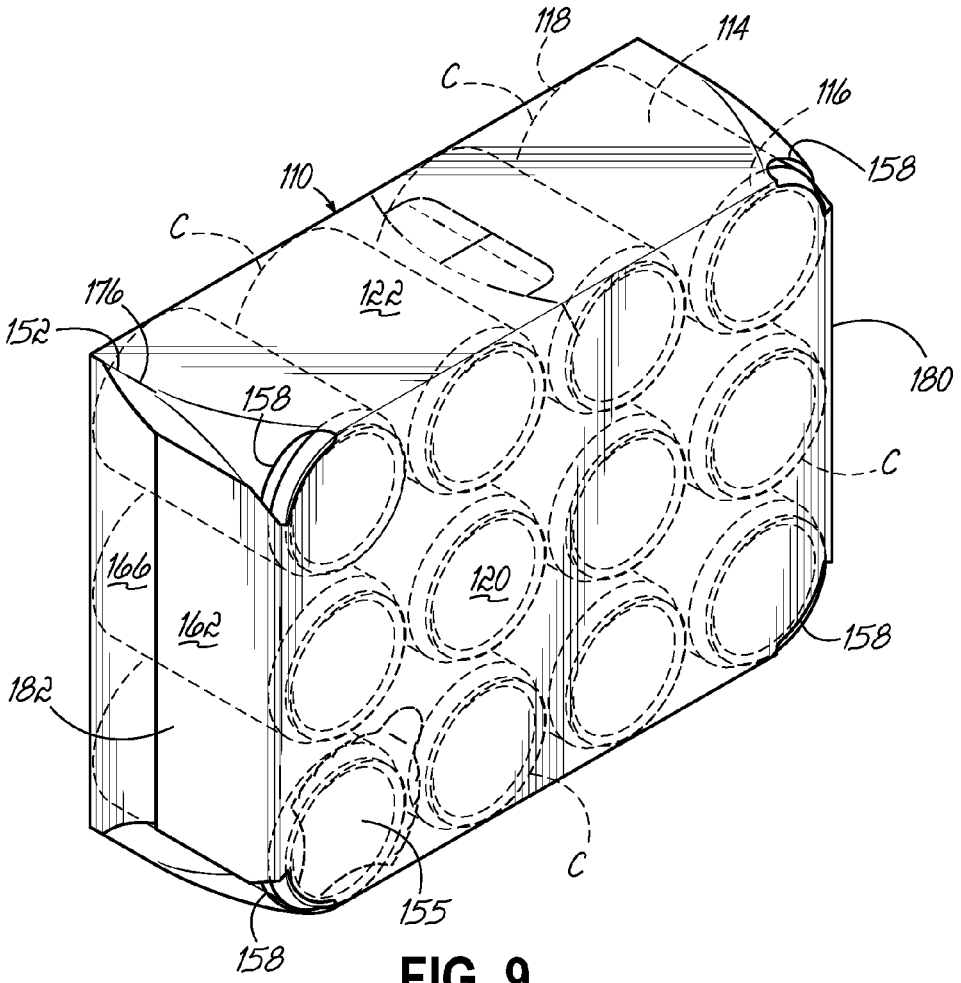
FIG. 9 is a perspective view of a carrier erected from the blank of FIG. 8.
Figure 10:
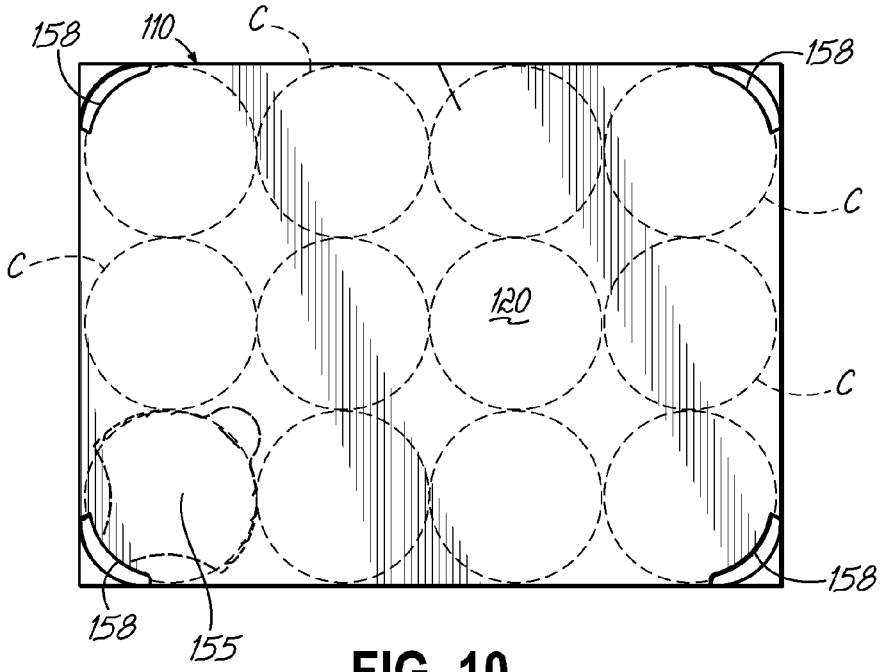
FIG. 10 is an elevational view of one side of the carrier of FIG. 9.

FIGS. 9-10 illustrate another embodiment of a carrier 110 according to this invention. FIG. 8 illustrates a blank 112 from which the carrier 110 of FIGS. 9-10 is formed. Cans or containers "C" arranged in a 3×4 array are to be contained in the carrier of FIGS. 9-10. However, this invention is not limited to a 3×4 arrangement and is readily used in a 2×6, other arrangement and/or sizes and types of containers. The cans "C" are each similarly oriented and have a cylindrical shape with an arcuate sidewall 114 extending from a top crown 116 of each container C to a bottom 118.

Referring to FIG. 8, the blank 112 includes four primary panels for forming carrier walls including a first panel 120, a second panel 124, a third panel 122 and a fourth panel 126 formed from two cooperating panels 126*a*, 126*b*. The panels are foldably connected one to the next along fold lines 128, 130, 132, 136.

Pair of flaps 138, 140 is attached to and extend from opposite ends of the fourth panel 126*b* as shown in FIG. 8. Each flap 138, 140 is connected to the panel 126*b* by a respective fold line 142, 144. A pair of opposed flaps 146, 148 adjoin to the third panel 122 each by an associated fold line 150, 152. Flaps 160, 162, 164, 166 are joined to respective ends of the associated panels 120, 124 by fold lines 168, 170, 172, 174, respectively. The fold lines 142, 144, 150, 152 joining the flaps 138, 140 and flaps 146, 148 to the respective panels are each oriented approximately 90 degrees relative to the adjacent fold line and form a rectangular-shaped panel 124 which in one embodiment may be square if the lengths of the fold lines 130, 132, 172, 174 bordering the side panel 124 are all equal. An arcuate corner 154 is at the juncture between each pair of adjacent fold lines bordering the panel 120. The arcuate corners 154 of the panel 120 combine to form viewing ports 158 of the carrier no when erected around the container configuration as shown in FIGS. 9-10. A dispenser 155 is formed in panel 120 and may be of any design and still within the scope of this invention.

Each fold line 142, 144, 150, 152 according to one aspect of this invention extends only partially along the juncture between the associated flap 138, 140, 146, 148 and the associated panel 126*b*, 122 as shown in FIG. 8. Specifically, each fold line 142, 144, 150, 152 extends from the portion of the associated panel 126*b*, 122 adjacent to the panel 124 toward the panel 120 when the carrier 110 is erected; however, according to one aspect of this invention, the fold lines 142, 144, 150, 152 do not extend the entire height of the associated flap 138, 140, 146, 148, panels 126*b*, 122 or the erected carrier 110 as shown in FIGS. 9-10. In one embodiment, each flap fold line 142, 144, 150, 152 extends approximately 50 percent of the height of the carrier 110 when the carrier 110 is resting on panel 124 or about half way from the panel 124 to the panel 120 in the erected carrier 110. As such, a portion of each flap 138, 140, 146, 148 is joined to the associated panel 126*b*, 122 by the fold line 142, 144, 150, 152 to form a non-arcuate juncture therebetween and the remainder of each flap 138, 140, 146, 148 is joined to the associated panel 126*b*, 122 without the benefit of a fold line as shown by region 176 to form an arcuate juncture between the adjacent associated panels. Panel 126*a* does not include any of the fold lines in one embodiment.

Another aspect of one embodiment of this invention is that the fold lines 142, 144, 168, 170, 172, 174 are each cut crease fold lines which include a series of spaced cuts or slits 178 along the fold line as well as associated creased, embossed or indented portions intermediately spaced between the cuts 178 in the paperboard. One of ordinary skill in the art would readily appreciate that alternative types of fold lines, crease lines, features or enhancements to the paperboard may be provided to allow the carrier blank 112 to be folded and erected into the carrier no according to various embodiments of this invention aside from those described and shown herein.

To form an erected carrier 110 from the blank 112, each container C is oriented with its longitudinal axis generally perpendicular to the panel 124 and is similarly oriented relative to one another such that each container bottom 118 is resting on the panel 124. The panel 120 is folded around about fold line 128 so that a distal portion of the panel 126*a* overlaps the complementary panel 126*b* which is then adhesively secured to the panel 126*a*. The side flaps 160, 162, 164, 166 are folded about respective fold lines 168, 170, 172, 174 relative to the associated panels 120, 124 after which the flaps 138, 140 are folded about their associated fold lines 142, 144 and the flaps 146, 148 are folded about fold lines 150, 152 to overlap the adjacent portion of the flaps 160, 162, 164, 166. The respective flaps 138, 140, 146, 148, 160, 162, 164, 166 are adhesively secured to one another via deposits of glue or another means as is well known in the industry. The overlapping flaps 138, 160, 146 and 164 form one composite end panel 180 of the carrier 110 and overlapping flaps 140, 162, 148, 166 and form another composite end panel 182.

One aspect of the carrier 110 according to this invention is the rectangular shape of the carrier around the bottom ends of the containers C and the upper portion of each panel 122, 126 and the adjacent portions of the respective end panels 180, 182 designated by areas 176 formed tightly around the upper portion of the arcuate sidewalls 114 of the containers C adjacent the viewing ports 158 of the carrier 110 as shown in FIGS. 9-10. This arrangement of the carrier 110 and the associated fold lines and side flaps allows for the generally rectangular configuration of the panel 124 and the rounded or non-rectangular configuration of the upper portion of the carrier 110 to provide a snug wrapping by areas 176 of the cylindrical containers C. Exposure of the containers C in the carrier 110 is provided by the viewing ports 158 bound in part by the arcuate corners 154.

Figure 11:
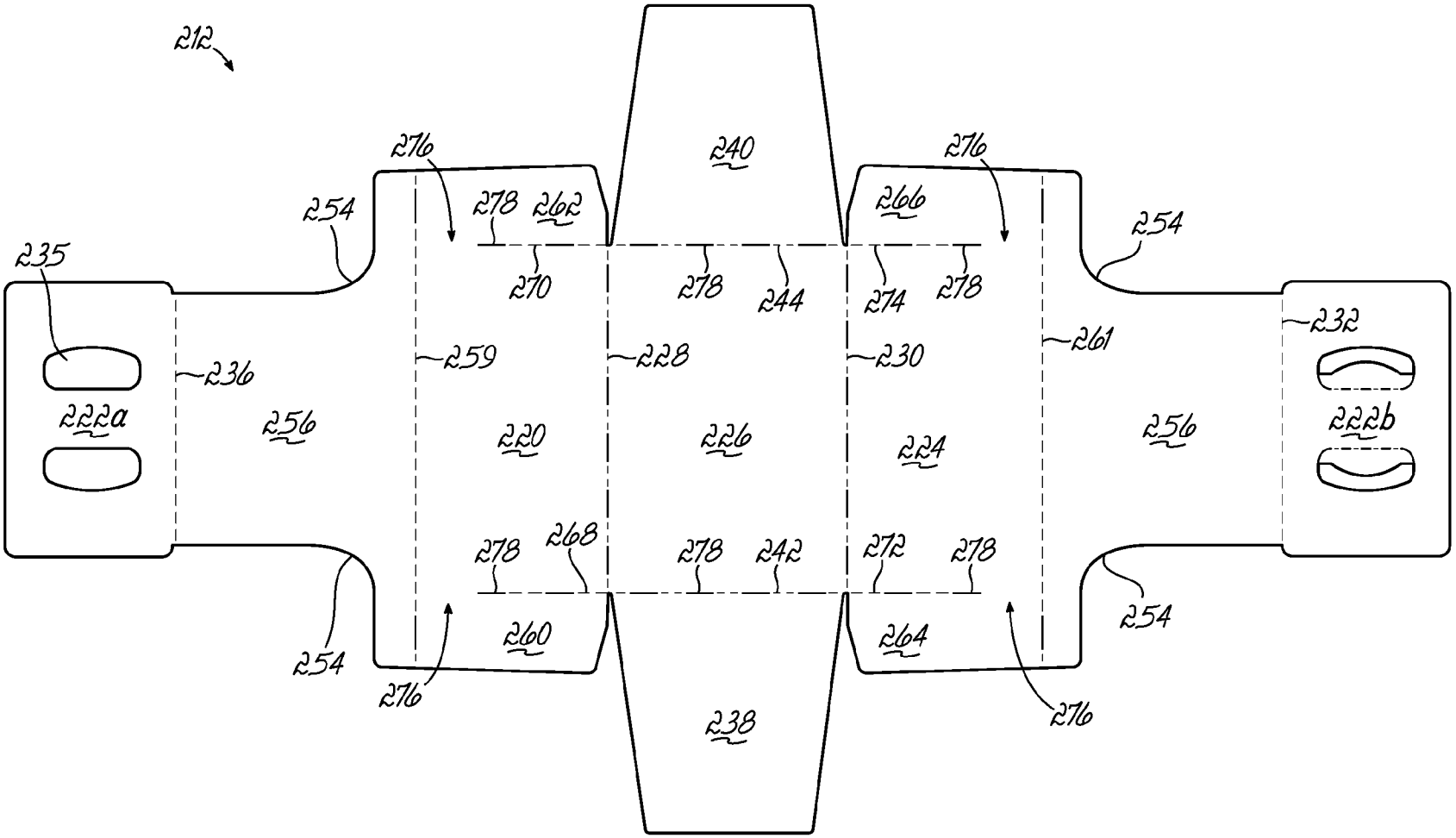
FIG. 11 is a plan view of a blank according to a still further embodiment of this invention.
Figure 12:
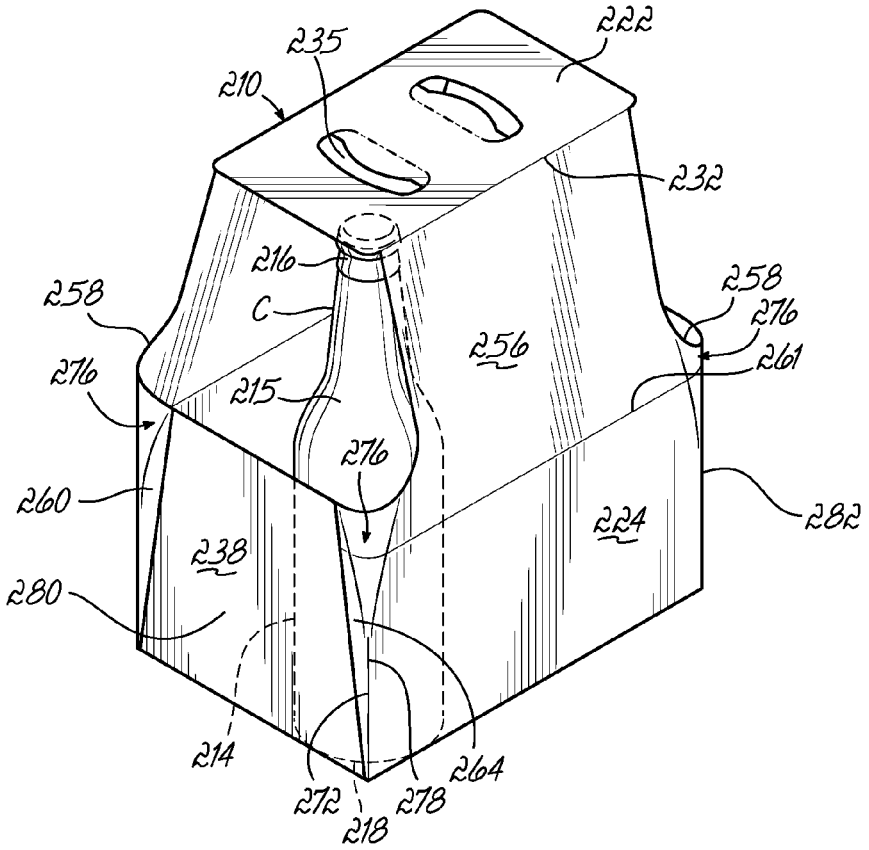
FIG. 12 is a perspective view of a carrier erected from the blank of FIG. 11.
Figure 13:
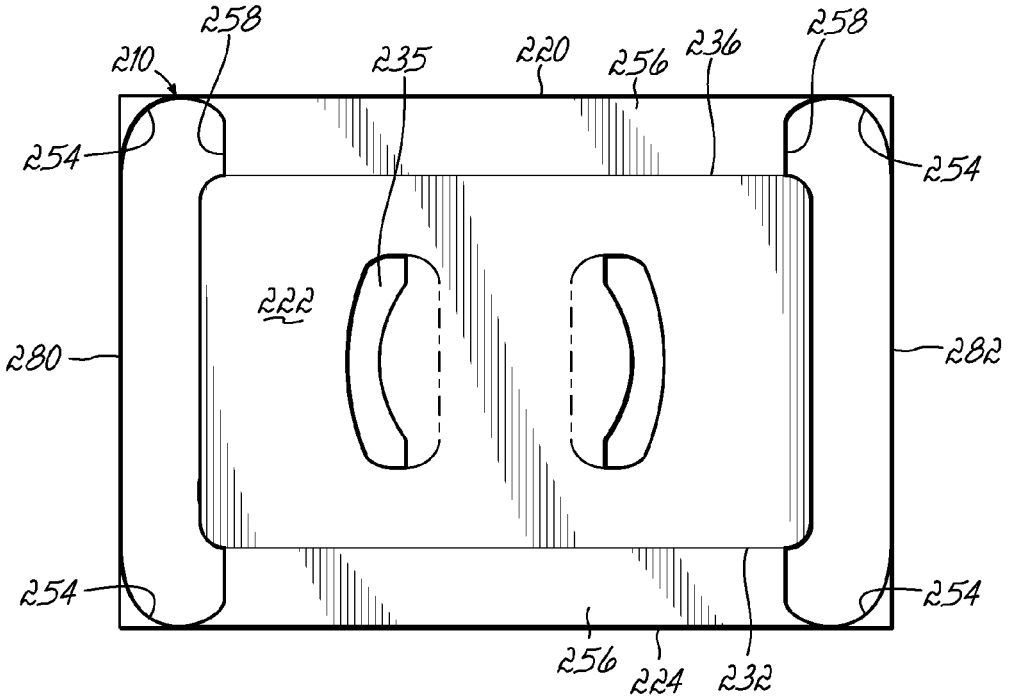
FIG. 13 is a top view of the carrier of FIG. 12.

FIGS. 12-13 illustrate a further embodiment of a carrier 210 according to this invention. FIG. 11 illustrates a blank 212 from which the carrier 210 of FIGS. 12-13 is formed. Bottles or containers "C" arranged in a 2×3 array are to be contained in the carrier 210. However, this invention is not limited to a 2×3 arrangement and is readily used in a 2×2, other arrangement and/or sizes and types of containers. The bottles "C" are each similarly oriented and have a cylindrical shape with an arcuate sidewall 214, as shoulder 215, a top crown 216, and a bottom 218.

Referring to FIG. 11, the blank 212 includes four primary panels for forming carrier walls including a first side panel 220, a top panel 222, a second side panel 224 and a bottom panel 226 foldably connected one to the next along fold lines 228, 230 and 232. The top panel 222 is formed from two overlapping panels 222*a*, 222*b*, each joined to the adjacent side panel 220, 224 by respective fold lines 236, 232. A handle 235 of any design or configuration may be formed in the top panel 222.

A pair of bottom flaps 238, 240 is attached to and extends from opposite ends of the bottom panel 226 as shown in FIG. 11. Each bottom flap 238, 240 is connected to the bottom panel 226 by a respective fold line 242, 244. The fold lines 242, 244, 230, 228 joining the bottom flaps 238, 240 and side panels 220, 224 to the bottom panel 226 are each oriented approximately 90 degrees relative to the adjacent fold line and form a rectangular-shaped bottom panel 226. An arcuate corner 254 is formed in each side panel 220, 224. Additionally, an extended neck portion 256 of the respective side panel 220, 224 at the juncture between each side panel 220, 224 and the top panel 222. The arcuate corners 254 and the neck portions 256 of the side panels 220, 224 combine to form viewing ports 258 of the carrier 210 when erected around the container configuration as shown in FIGS. 12-13. A fold line 259, 261 may extend transversely across the side panel 220, 224, respectively, as shown in FIGS. 11-13.

Pairs of opposed side flaps 260, 262 and 264, 266 are each joined to and extend from the opposite edges of the side panels 220, 224 as shown in the blank 212 in FIG. 11. Each side flap 260, 262, 264, 266 is joined to the associated side panel 220, 224 by a side flap fold line 268, 270, 272, 274. Each side flap fold line 268, 270, 272, 274 according to one aspect of this invention extends only partially along the juncture between the side flap 260, 262, 264, 266 and the associated side panel 220, 224 as shown in FIG. 11. Specifically, each side flap fold line 268, 270, 272, 274 extends from the portion of the side panel 220, 224 adjacent to the bottom panel 226 toward the top panel 222; however, according to one aspect of this invention, the side flap fold lines 268, 270, 272, 274 do not extend the entire height of the associated side flap 260, 262, 264, 266, side panels 220, 224 or the erected carrier 210 as shown in FIGS. 12-13. In one embodiment, each side flap fold line 268, 270, 272, 274 extends approximately 50 percent of the height of the carrier 210 or about half way from the bottom panel 226 to the arcuate corner 254 in the erected carrier 210. As such, a portion of each side flap 260, 262, 264, 266 is joined to the associated side panel 220, 224 by the side flap fold line 268, 270, 272, 274 to form a non-arcuate juncture between the adjacent associated panels and the remainder of each side flap 260, 262, 264, 266 is joined to the associated side panel 220, 224 without the benefit of a fold line as shown by region 276 to form an arcuate juncture between the adjacent associated panels.

Another aspect of one embodiment of this invention is that the fold lines 242, 244, 268, 270, 272, 274 joining the bottom panel 226 to the bottom flaps 238, 240 and those joining the side flaps 260, 262, 264, 266 to the associated side panels 220, 224 are each cut crease fold lines which include a series of spaced cuts or slits 278 along the fold line as well as associated creased, embossed or indented portions intermediately spaced between the cuts 278 in the paperboard. One of ordinary skill in the art would readily appreciate that alternative types of fold lines, crease lines, features or enhancements to the paperboard may be provided to allow the carrier blank 212 to be folded and erected into the carrier 210 according to various embodiments of this invention aside from those described and shown herein.

To form an erected carrier 210 from the blank 212 according to one aspect of this invention, the configuration of containers C is loaded onto the bottom panel 226 of the carrier blank 212 and is shown in a 2×3 arrangement in FIGS. 12-13, although other configurations of containers C are possible within the scope of this invention. Each container C is oriented with its longitudinal axis generally perpendicular to the bottom panel 226 and is similarly oriented relative to one another such that each container bottom 218 is resting on the bottom panel 226. The side panels 220, 224 are then each folded around about respective fold line 228, 232 and the containers C so that panel 222*a* overlaps the panel 222*b* which are then adhesively secured together. The side flaps 260, 262, 264, 266 are then folded about respective fold lines 268, 270, 272, 274 relative to the associated side panels 220, 224 after which the bottom flaps 238, 240 are folded upwardly about their associated fold lines 242, 244. The respective flaps 238, 240, 260, 262, 264, 266 are adhesively secured to one another via deposits of glue or another means as is well known in the industry. The overlapping flaps 238, 260, 264 form one composite end panel 280 of the carrier 210 and overlapping flaps 240, 262, 266 and form another composite end panel 282.

One aspect of the carrier 210 according to this invention is the generally perpendicular orientation of the side panels 220, 224 relative to the composite end panels 280, 282 and the adjacent bottom panel 226 due in part to the side flap fold lines 268, 270, 272, 274. However, the upper portion of each side panel 220, 224 designated by areas 276 is formed tightly around the upper portion of the arcuate sidewalls 214 of the containers C adjacent proximate the shoulder 215 and the viewing ports 258 of the carrier 210 as shown in FIGS. 12-13. This arrangement of the carrier 210 and the associated fold lines and side flaps allows for the generally rectangular configuration of the bottom panel 226 and the adjacent portions of the side panels 220, 224 and end panels 280, 282 and the rounded or non-rectangular configuration of the upper portion of the carrier 210 to provide a snug wrapping by areas 276 of the cylindrical containers C. Exposure of the containers C in the carrier 210 is provided by the viewing ports 258 bound in part by the arcuate corners 254 and the neck portions 256.

Having described various embodiments of this invention, terms such as side, top, bottom and the like are utilized for a better understand of the invention and not as limitations on the invention. It should be further appreciated that any reference to hinged or foldable connection should not be construed as necessarily referring to a single fold line only. Hinged connections can be formed from one or more of one of the following: a score line, a frangible line, a cut crease line or a fold line, without departing from the scope of invention.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A blank for forming a carrier sized to contain a plurality of containers, the blank comprising:

serially connected bottom, first side, top and second side panels;

a plurality of flaps extending from at least some of the panels to form a pair of opposed composite end panels of the formed carrier;

a plurality of fold lines joining at least some of the flaps to an associated panel~wherein each of the fold lines is located at a juncture between the flap and the associated panel;

wherein selected ones of the fold lines do not extend the entire length of the juncture between the at least some of the flaps and the panels associated therewith;

and wherein each of the containers has a generally arcuate sidewall and a portion of the at least some of the flaps spaced from the bottom panel is wrapped around and has the same shape as a portion of the generally arcuate sidewall of selected containers when the blank is formed into the carrier.

2. The blank of claim 1 wherein when the selected ones of the fold lines extend about 50% of the juncture between the at least some of the flaps and the panels associated therewith.

3. The blank of claim 1 further comprising:

a plurality of arcuate corners on the top panel; and a narrowed neck region extending from each of the first and second side panels to the respective juncture with the top panel.

4. The blank of claim 1 wherein the bottom panel is joined to one of the side panels by a side panel fold line which extends the entire length of a juncture between the bottom panel and the one of the side panels.

5. The blank of claim 4 wherein two of the plurality of flaps each extend from opposite ends of the bottom panel and are each joined to the bottom panel by one of two bottom panel fold lines which extend the entire length of a juncture between the bottom panel and the associated one of the two flaps.

6. The blank of claim 1 wherein the bottom panel is generally rectangular and supports a bottom of each of the containers when the blank is formed into the carrier.

7. The blank of claim 1 wherein a portion of the at least some of the flaps adjacent to the bottom panel is formed into a non-arcuate corner about the selected ones of the fold lines.

8. The blank of claim 1 wherein the entirety of the selected ones of the fold lines extend generally parallel to each other.

9. A blank for forming a carrier sized to contain a plurality of containers each having a generally arcuate sidewall, the blank comprising:

serially connected bottom, first side, top and second side panels;

wherein the bottom panel is generally rectangular and supports a bottom of each of the containers when the blank is formed into the carrier;

a plurality of flaps extending from at least some of the panels to form a pair of opposed composite end panels of the formed carrier;

a plurality of fold lines joining at least some of the flaps to an associated panel, wherein each of the fold lines is located at a juncture between the flap and the associated panel;

wherein selected ones of the fold lines do not extend the entire length of the juncture between the at least some of the flaps and the panels associated therewith, wherein the selected ones of the fold lines extend generally parallel to each other;

a plurality of arcuate corners on the top panel;

a narrowed neck region extending from each of the first and second side panels to the respective juncture with the top panel;

wherein the bottom panel is joined to one of the side panels by a side panel fold line which extends the entire length of a juncture between the bottom panel and the one of the side panels;

wherein two of the plurality of flaps each extend from opposite ends of the bottom panel and are each joined to the bottom panel by one of two bottom panel fold lines which extend the entire length of a juncture between the bottom panel and the associated one of the two flaps; and a first portion of the at least some of the flaps spaced from the bottom panel is wrapped around and has the same shape as a portion of the generally arcuate sidewall of selected containers when the blank is formed into the carrier and a second portion of the at least some of the flaps adjacent to the bottom panel is formed into a non-arcuate corner about the selected ones of the fold lines.

10. A package comprising:

a plurality of similarly oriented, sized and configured containers arranged in an array and each having a bottom, a top and a generally arcuate sidewall therebetween;

a carrier formed around the array of containers with the bottom of each container supported on a bottom panel of the carrier;

a plurality of carrier side panels extending upwardly from the bottom panel;

at least one fold line extending upwardly from the bottom panel between an adjacent pair of the side panels forming a non-arcuate lower juncture portion between the adjacent pair of side panels adjacent to the bottom panel;

an upper juncture portion between the adjacent pair of side panels of the carrier and spaced from the bottom panel, the upper juncture portion being wrapped around and having the same shape as a portion of the arcuate sidewall of one of the containers;

and wherein the fold line extends only partially between the bottom panel and a top panel of the carrier.

11. The package of claim 10 further comprising:

the top panel is positioned over positioned over the tops of the containers.

12. The package of claim 10 wherein the side panels of the adjacent pair of side panels are oriented generally perpendicular to each other at the lower juncture portion.

13. The package of claim 10 wherein two of the plurality of carrier side panels are opposed to one another and each are composite side panels formed from flaps extending from selected ones of the remaining side panels and bottom panel of the carrier.

14. The package of claim 13 wherein the bottom panel of the carrier is generally rectangular and the plurality of carrier side panels numbers four and each adjacent pair of carrier side panels has the fold line, the lower juncture portion and upper juncture portion therebetween.

15. The package of claim 11 further comprising:

a viewing port subjacent to the top panel and superjacent to the upper juncture portion.

16. The package of claim 10 wherein a lower perimeter profile of the package adjacent to the bottom panel is generally rectangular and an upper perimeter profile of the package spaced from the bottom panel is generally non-rectangular.

17. A package comprising:

a plurality of similarly oriented, sized and configured containers arranged in an array and each having a bottom, a top and a generally arcuate sidewall therebetween;

a carrier formed around the array of containers with the bottom of each container supported on a generally rectangular bottom panel of the carrier and a top panel of the carrier positioned over the tops of the containers;

first, second, third and fourth carrier side panels each extending upwardly from the bottom panel;

wherein the first and third carrier side panels are opposed to one another and each are composite side panels formed from flaps extending from selected ones of the remaining side panels, the top panel and the bottom panel of the carrier;

first, second, third and fourth fold lines each extending upwardly from the bottom panel between an adjacent pair of the side panels forming a non-arcuate lower juncture portion between the associated adjacent pair of side panels adjacent to the bottom panel, wherein each of the fold lines is located at a juncture between the flap and the associated panel;

wherein the side panels of the adjacent pair of side panels are oriented generally perpendicular to each other at the lower juncture portion;

wherein each fold line extends only partially between the bottom panel and top panel of the carrier;

an upper juncture portion between the adjacent pair of side panels of the carrier and spaced from the bottom panel, the upper juncture portion being wrapped around and having the same shape as a portion of the arcuate sidewall of one of the containers; and first, second, third and fourth viewing ports each subjacent to the top panel and superjacent to one of the upper juncture portions;

wherein a lower perimeter profile of the package adjacent to the bottom panel is generally rectangular and an upper perimeter profile of the package spaced from the bottom panel is generally non-rectangular.

18. The blank of claim 1 wherein the selected ones of the fold lines each emanate from an edge of the associated panel.

19. The blank of claim 1 wherein each of the selected ones of the fold lines borders both the flap and the panel associated therewith.

20. The blank of claim 1 wherein each of the selected ones of the fold lines is linear.

21. The blank of claim 9 wherein the selected ones of the fold lines each emanate from an edge of the associated panel, borders both the flap and the panel associated therewith and is linear.

22. The package of claim 10 wherein the selected ones of the fold lines each emanate from an edge of the associated panel.

23. The package of claim 10 wherein each of the selected ones of the fold lines borders both the flap and the panel associated therewith.

24. The package of claim 10 wherein each of the selected ones of the fold lines is linear.

25. The package of claim 17 wherein the selected ones of the fold lines each emanate from an edge of the associated panel, borders both the flap and the panel associated therewith and is linear.

* * * * *

UNITED STATES PATENT AND TRADEMARK OFFICE

CERTIFICATE OF CORRECTION

PATENT NO. : 8,997,987 B1
APPLICATION NO. : 13/871324
DATED : April 7, 2015
INVENTOR(S) : Steven J. Block It is certified that error appears in the above-identified patent and that said Letters Patent is hereby corrected as shown below:

In the Specification:

At column 5, line approximately 29, "ports 158 of the carrier no when" should read -- ports 158 of the carrier 110 when --.

At column 5, line approximately 65, "into the carrier no according" should read -- into the carrier 110 according --.

In the Claims:

At column 10, claim number 11, line number 9, "the top panel is positioned over positioned over the tops" should read -- the top panel is positioned over the tops --.

Signed and Sealed this
Twenty-first Day of July, 2015

Michelle K. Lee

Michelle K. Lee
*Director of the United States Patent and Trademark Office*